US007082663B2

(12) United States Patent
Blöcher et al.

(10) Patent No.: US 7,082,663 B2
(45) **Date of Patent: *Aug. 1, 2006**

(54) METHOD FOR RIVETING OR PIERCING AND A DEVICE FOR CARRYING OUT THE METHOD

(75) Inventors: Michael Blöcher, Biedenkopf (DE); Joachim Möser, Gruenberg (DE); Reinhold Opper, Alten-Buseck (DE)

(73) Assignee: Newfrey LLC, Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/984,824

(22) Filed: Nov. 10, 2004

(65) Prior Publication Data

US 2005/0081360 A1 Apr. 21, 2005

Related U.S. Application Data

(62) Division of application No. 10/042,623, filed on Jan. 9, 2002, now Pat. No. 6,857,175.

(30) Foreign Application Priority Data

Jan. 15, 2001 (DE) ..... 101 01 724
Apr. 30, 2001 (DE) ..... 101 21 219

(51) Int. Cl.
*B23Q 17/00* (2006.01)
*B23P 21/00* (2006.01)

(52) U.S. Cl. ..... 29/407.05; 29/715

(58) Field of Classification Search ..... 29/407.05, 29/715, 407.06, 407.09, 432, 505, 524.1, 29/525, 525.01, 525.05, 525.08, 716, 718, 29/709, 712, 714

See application file for complete search history.

(56) References Cited

U.S. PATENT DOCUMENTS 580,771 A 4/1897 Caskey
686,352 A 11/1901 Sellers et al.
907,853 A 12/1908 Murphy
6,857,175 B1 * 2/2005 Blocher et al. ..... 29/407.05

FOREIGN PATENT DOCUMENTS

JP 62-179825 8/1997

* cited by examiner

*Primary Examiner*—John C. Hong
(74) *Attorney, Agent, or Firm*—Miles & Stockbridge P.C.

(57) ABSTRACT

A method and apparatus in which a workpiece is supported on one arm of a C-shaped counterforce structure and is operated upon by a mechanism supported on the other arm of the counterforce structure. The operation causes deformation of the counterforce structure, which is measured, and the operation is adjusted responsive to the measured deformation.

32 Claims, 1 Drawing Sheet

METHOD FOR RIVETING OR PIERCING AND A DEVICE FOR CARRYING OUT THE METHOD

CROSS-REFERENCE TO RELATED APPLICATION

Figure 1:
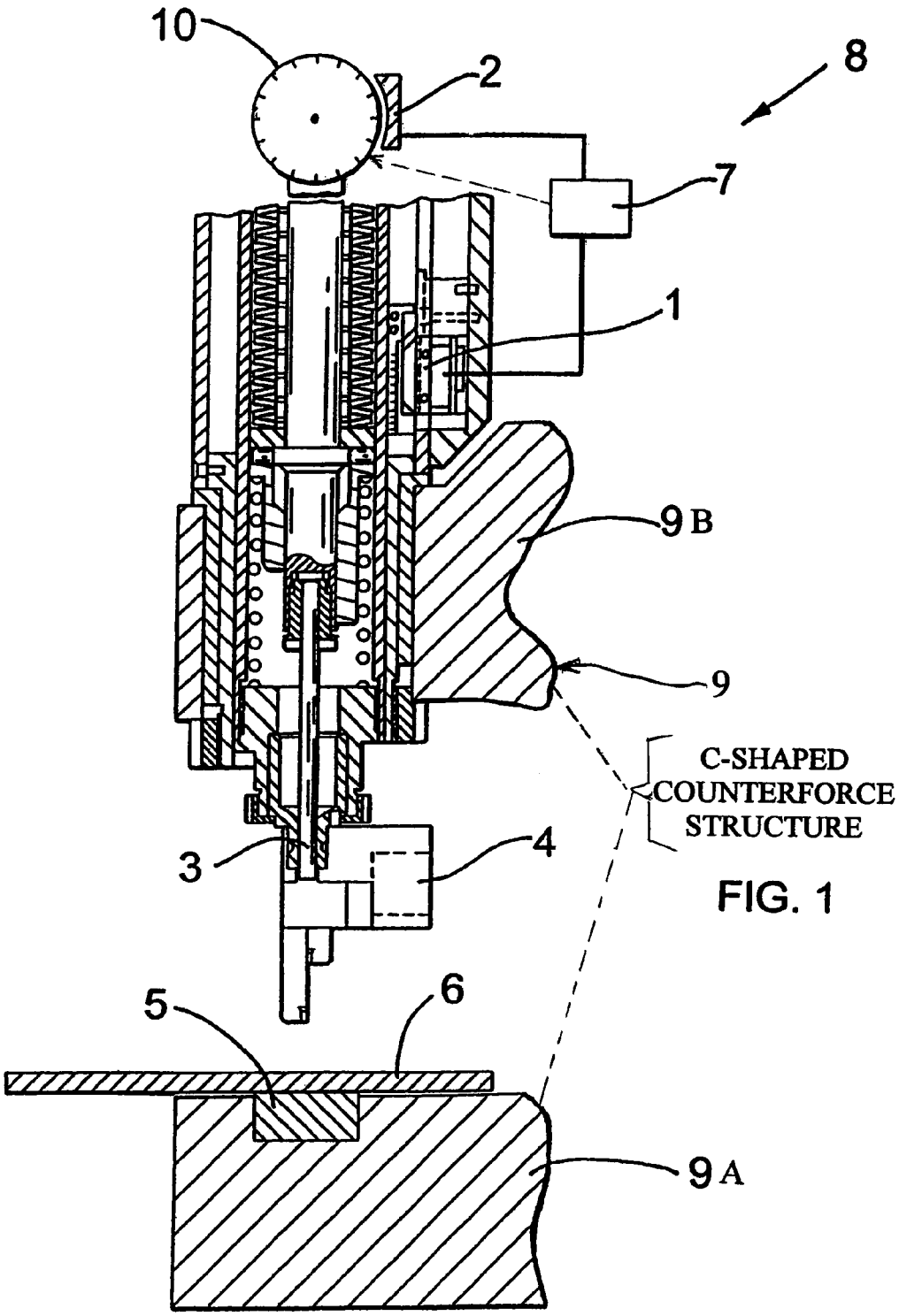

This application is a division of application Ser. No. 10/042,623 filed Jan. 9, 2002 now U.S. Pat. No. 6,857,175.

BACKGROUND OF THE INVENTION

The present invention relates to a method for riveting, or self-piercing, and a device for carrying out the method. The large forces on a workpiece which occur when a rivet is set or during piercing must be compensated by a counterforce. This is usually achieved by supporting the workpiece on a counterforce structure, which preferably substantially has the shape of a C and is therefore also usually designated as a C-bracket.

For the precise setting of a rivet or accurate self-piercing it is important to know how deeply a rivet or a die has penetrated into the workpiece. This problem arises in particular when large workpieces are being processed, where the counterforce structure (C-bracket) is very large. In practice arm lengths of C-brackets occur of up to 1.5 metres. Deformation of the counterforce structure occurs in particular with large forces acting on the workpiece, so the actual self-piercing depth or the rivet head projection is determined only inaccurately. This problem is particularly significant when short rivets, hard materials and large workpieces are used. Distortion of the counterforce structure results in considerable inaccuracies with respect to the piercing depth or the rivet head projection.

To date it has been usual to construct the counterforce structure as large and as resistant to bending as possible. To keep deformation within an acceptable scope considerable expenditure and costs in the construction of the counterforce brackets have been necessary. Compensation of any deformations of the counterforce bracket took place manually, after the fault had been detected empirically.

SUMMARY OF THE INVENTION

It is the object of the present invention to disclose a method for riveting, or self-piercing, which overcomes the disadvantages of the prior art and to allow the setting or piercing process to run particularly accurately, as well as to describe a device for carrying out the method.

In the method for riveting or piercing with a counterforce bracket according to the invention the deformation of the counterforce structure during a riveting or piercing process is detected by a monitoring unit and a course of movement during the riveting or piercing process is corrected as a function of the bending. Detection of the deformation of the counterforce structure, which can vary according to the piercing or setting force, the materials used, the rivets used and other parameters specific to material or shape, as different forces occur, allows flexible adaptation to every operational situation. The position of the rivet head is precisely achieved by correcting the course of movement during the riveting or piercing process as a function of the bending. The inaccuracies during the riveting or piercing process due to the deformation of the counterforce structure are compensated in certain limits. An advantageous consequence of this method can even be that counterforce structures can be used which have less stiffness or higher deformability, so they can be more simply constructed and therefore production costs can be saved.

Typically a setting device has a die plate, a pick-up device and a die guided in the pick-up device, which presses directly or indirectly on a workpiece, located between die plate and pick-up device. When the pick-up device makes contact with the workpiece the riveting depth can be determined from the relative movement between pick-up device and die. A disadvantage of this, however, is that the cable ducts needed for detecting the relative movement between die and pick-up device suffer from the constant movement both of the pick-up device and of the die in long-term operation and in time are subjected to wear phenomena.

In a preferred configuration of the method according to the invention the relative movement between pick-up device and counterforce structure is detected by a first sensor, and the relative movement between pick-up device and die and between die and counterforce structure is detected by a second sensor. Responsive to this, the depth of the riveting or piercing is adjusted with the aid of the two measured values. The two sensors are preferably constructed as path sensors, in particular digital step counters. It is important herein that not only the relative displacement between pick-up device and die is detected, but additionally also the movement of the pick-up device due to deformations of the counterforce structure.

According to an advantageous further development of the method the setting of the die and the pick-up device on the die plate or on a workpiece is detected by a measurement of the force on the drive of the die. By measuring a reference position at a defined force when the die and/or the pick-up device are set, calibration can be performed in a simple manner. The measurement of the force takes place via the housing, so the forces exerted by the die and the holding-down clamp are measured together. With this information the actual depth of the riveting or piercing, and also the length of the riveting can then be accurately determined. These reference measurements can also be used to determine the thickness of workpieces accurately and quickly. The relative displacement between die and pick-up device at the deepest point corresponds exactly to the pressing depth or the rivet head projection.

The method according to the invention in a preferred embodiment has the effect that a predetermined movement path of the die towards the workpiece, based on a desired piercing depth or a desired rivet head projection, is lengthened by the relative movement between counterforce structure and pick-up device measured by the first sensor during the riveting or piercing process. With different hardness of the material to be processed, but also even with different temperatures, etc., the forces occurring during riveting or self-piercing are different, leading to deformations of the counterforce structure which cannot be accurately determined empirically. By means of the compensation according to the invention with the relative movement measured by the first sensor, which exactly corresponds to the deformation of the counterforce structure, a constant setting or self-piercing depth can nevertheless be achieved.

In addition, however, the measurement of the deformation of the counterforce structure can also provide further valuable information, in other words, for example, on the quality of the material to be processed, the state of the counterforce structure, the quality of the process carried out itself, etc. This is another substantial advantage of the invention.

A riveting or piercing device according to the invention, in particular for carrying out the above method, has a pick-up device and a die guided by the pick-up device, which in each case can be moved towards a die plate or a workpiece, wherein die plate and riveting or piercing device are connected to one another via a counterforce structure, in particular a C-shaped counterforce bracket. In that a first sensor is present which measures the relative movement between pick-up device and counterforce structure and a second sensor is present which measures the relative movement between pick-up device and die or between die and counterforce structure, an exact detection of the actual position of the die relative to the die plate or the workpiece is possible. Deviations from the target position can for the first time be corrected by adjusting during the course of movement and no longer have to be manually input based on empirical observations.

Preferably the first path recorder is a linear path recorder, preferably a digital counter, which, for example, counts stroke-shaped markings on a kind of ruler. This enables fast and accurate processing of the signals in a monitoring unit.

BRIEF DESCRIPTION OF THE ACCOMPANYING DRAWINGS

Further special configurations and advantages of the invention are explained in the following drawing using a rivet setting, or self-piercing, machine.

FIG. 1 is a side elevational view, partly in section, of a rivet setting or piercing machine of the preferred embodiment of the present invention.

DETAILED DESCRIPTION OF THE PREFERRED EMBODIMENTS

FIG. 1 shows a riveting device B, but a self-piercing machine (not shown) could have been illustrated to show the present invention. The riveting device 8 has a counterforce structure 9 surrounding a workpiece 6 in the form of a C-shaped bracket of which only the outer portions are shown. The workpiece 6 is supported on a die plate 5 on one arm, 9A, of the counterforce structure 9. A pick-up device 4 picks up rivets, which are driven into the workpiece 6 with the aid of a die 3 driven by a drive unit 10 on another arm, 9B, of the counterforce structure 9. A first sensor 1 measures the relative movement between pick-up device 4 and counterforce structure 9. This sensor is preferably a linear path recorder consisting of a kind of ruler which makes the same movement as the pick-up device 4 and a counter which is fixed to the counterforce structure 9 and counts markings on the ruler going past it. A second sensor 2 measures the relative movement between counterforce structure 9 and die 3. Sensors of this kind are known per se and usually integrated into the drive unit 10 of the die 3. With spindle drives they are, for example, step counters. The first sensor 1 and the second sensor 2 are connected to a monitoring unit 7, which can thereby detect the bending of the counterforce structure 9 during action of the force exerted by the die 3 and the pick-up device 4 on the workpiece 6. With the knowledge of the bending of the counterforce structure 9 detected in this way the movement of the die 3 can be adjusted in such a way that a constant penetration depth of the rivets is always ensured. Owing to the correction, the counterforce bracket 9 can possibly be constructed as even lighter, smaller and more economical.

The method for riveting or piercing, in which the deformation of the counterforce structure 9 during a riveting or piercing process is detected by a monitoring unit 7 and a course of movement during the riveting or piercing process is corrected as a function of the bending, is particularly suitable for guaranteeing particularly good reproducibility of the setting depth or of the rivet head projection and therein gaining additional information on the working process.

It will also be appreciated that the above-described invention may be embodied in other specific forms without departing from the spirit or essential characteristics thereof. The present embodiments are, therefore, to be considered in all aspects as illustrative and not restrictive, the scope of the invention being indicated by the appended claims rather than by the foregoing description, and all changes which come within the meaning and range of equivalency are, therefore, intended to be embraced therein.

The invention claimed is:

1. A method of operating on a workpiece supported on one arm of a C-shaped counterforce structure and operated upon by a mechanism supported on the other arm of the counterforce structure, comprising:

using the mechanism to perform an operation on the workpiece that causes deformation of the counterforce structure;

measuring the deformation of the counterforce structure; and adjusting the operation responsive to the measured deformation.

2. A method according to claim 1, wherein the workpiece is adjacent to a female die supported on the one arm of the counterforce structure, and the mechanism supported on the other arm of the counterforce structure has a male die that cooperates with the female die to perform the operation.

3. A method according to claim 2, wherein the adjusting adjusts movement of the male die.

4. A method according to claim 2, further comprising recording the measured deformation of the counterforce structure as a quality signal of any of a quality of the counterforce structure, the nature of the workpiece, the dies and the operation.

5. A method according to claim 1, wherein the adjusting adjusts penetration of the workpiece by an element of the mechanism.

6. A method according to claim 1, wherein the adjusting adjusts length of movement of an element of the mechanism.

7. A method according to claim 1, wherein the adjusting occurs during the performance of the operation.

8. A method according to claim 1, further comprising performing a calibration to assist in performing an operation.

9. A method according to claim 1, wherein the adjusting provides uniformity of the operation on the workpiece.

10. A method according to claim 1, wherein the deformation measurement involves measurement of relative movement of the arms of the counterforce structure during the operation on the workpiece.

11. A method according to claim 1, wherein the operation is a riveting operation and the adjusting provides an intended rivet head projection on the workpiece.

12. A method according to claim 1, wherein the operation is a riveting operation and the adjusting adjusts a force of the riveting operation.

13. A method according to claim 1, wherein the operation is a riveting operation and the adjusting adjusts a depth of the riveting operation.

14. A method according to claim 1, wherein the operation is a piercing operation and the adjusting adjusts a force of the piercing operation.

15. A method according to claim 1, wherein the deformation is bending of the counterforce structure.

16. A method of operating on a workpiece supported on one arm of a C-shaped counterforce structure and operated upon by a mechanism supported on the other arm of the counterforce structure, comprising:

using the mechanism to perform an operation on the workpiece that causes relative movement of the arms of the counterforce structure;

measuring the movement; and adjusting the operation responsive to the measured movement.

17. A method of operating on a workpiece supported on one arm of a C-shaped counterforce structure and operated upon by a mechanism supported on the other arm of the counterforce structure, comprising:

using the mechanism to apply a force to the workpiece that causes deformation of the counterforce structure;

measuring the deformation of the counterforce structure; and adjusting the force responsive to the measured deformation.

18. A method of operating on a workpiece supported on one arm of a C-shaped counterforce structure and operated upon by a mechanism supported on the other arm of the counterforce structure, comprising:

using the mechanism to apply a force to the workpiece that causes deformation of the counterforce structure;

measuring relative movement between the counterforce structure and a device associated with the mechanism due to the deformation; and adjusting the force responsive to the measured relative movement.

19. Apparatus comprising:

a C-shaped counterforce structure;

means for supporting a workpiece on one arm of the counterforce structure;

a mechanism supported on the other arm of the counterforce structure for performing an operation on the workpiece that causes deformation of the counterforce structure;

means for measuring the deformation of the counterforce structure; and means for adjusting the operation responsive to the measured deformation.

20. Apparatus according to claim 19, wherein the means for supporting the workpiece on the one arm of the counterforce structure includes a female die, and the mechanism supported on the other arm of the counterforce structure has a male die that cooperate with the female die to perform the operation.

21. Apparatus according to claim 20, wherein the means for adjusting the operation adjusts movement of the male die.

22. Apparatus according to claim 19, wherein the means for adjusting adjusts penetration of the workpiece by an element of the mechanism.

23. Apparatus according to claim 19, wherein the means for adjusting adjusts the operation during the performance of the operation.

24. Apparatus according to claim 19, wherein the means for measuring deformation measures relative movement of the arms of the counterforce structure during the operation on the workpiece.

25. Apparatus according to claim 19, wherein the apparatus is a riveting apparatus and the means for adjusting adjusts projection of a rivet head on the workpiece.

26. Apparatus according to claim 19, wherein the apparatus is a riveting apparatus and the means for adjusting adjusts a force of a riveting operation.

27. Apparatus according to claim 19, wherein the apparatus is a riveting apparatus and the means for adjusting adjusts a depth of a riveting operation.

28. Apparatus according to claim 19, wherein the apparatus is a piercing apparatus and the means for adjusting adjusts a force of a piercing operation.

29. An apparatus according to claim 19, wherein the deformation is bending of the counterforce structure.

30. Apparatus comprising:

a C-shaped counterforce structure;

means for supporting a workpiece on one arm of the counterforce structure;

a mechanism supported on the other arm of the counterforce structure for performing an operation on the workpiece that causes relative movement of the arms of the counterforce structure;

means for measuring the movement; and means for adjusting the operation responsive to the measured movement.

31. Apparatus comprising:

a C-shaped counterforce structure;

means for supporting a workpiece on one arm of the counterforce structure;

a mechanism supported on the other arm of the counterforce structure for applying a force to the workpiece that causes deformation of the counterforce structure;

means for measuring the deformation of the counterforce structure; and means for adjusting the force responsive to the measured deformation.

32. Apparatus comprising:

a C-shaped counterforce structure;

means for supporting a workpiece on one arm of the counterforce structure;

a mechanism supported on the other arm of the counterforce structure for applying a force to the workpiece that causes deformation of the counterforce structure;

means for measuring relative movement between the counterforce structure and a device associated with the mechanism, due to the deformation; and means for adjusting the force responsive to the measured movement.

* * * * *